US005981134A

United States Patent [19]

Miyamoto et al.

[11] Patent Number: 5,981,134

[45] Date of Patent: Nov. 9, 1999

[54] LIQUID DEVELOPER FOR ELECTROPHOTOGRAPHY

[75] Inventors: Hidetoshi Miyamoto; Seishi Ojima, both of Takatsuki; Toshimitsu Fujiwara, Osaka, all of Japan

[73] Assignee: Minolta Co., Ltd., Osaka, Japan

[21] Appl. No.: 09/045,828

[22] Filed: Mar. 23, 1998

[30] Foreign Application Priority Data

Mar. 25, 1997 [JP] Japan ..... 9-071851
Mar. 25, 1997 [JP] Japan ..... 9-072001

[51] Int. Cl.[6] ..... G03G 9/135

[52] U.S. Cl. ..... 430/115; 430/137

[58] Field of Search ..... 430/114, 115, 430/137

[56] References Cited

U.S. PATENT DOCUMENTS 5,393,636 2/1995 Sugita et al. ..... 430/137
5,589,312 12/1996 Horie et al. ..... 430/137
5,753,763 5/1998 Rao et al. ..... 430/114
5,759,733 6/1998 Tsubuko et al. ..... 430/115

*Primary Examiner*—John Goodrow
*Attorney, Agent, or Firm*—McDermott, Will & Emery

[57] ABSTRACT

A liquid developer for electrophotography using a polyester resin as a toner binder resin which is suitable for high-speed systems and has excellent stability over time is disclosed.

The invention is a novel liquid developer for electrophotography having colored particles dispersed in an electrically insulated fluid medium. The liquid developer includes an oil-soluble ionic surface active agent as a charge controller. According to one embodiment, the colored particles include a binder resin having an acid value of 40 mgKOH/g or higher but less than or equal to 100 mgKOH/g. According to another embodiment, the colored particles include a binder resin having a glass transition temperature Tg of 35° C. or higher but less than or equal to 65° C.

26 Claims, 1 Drawing Sheet

LIQUID DEVELOPER FOR ELECTROPHOTOGRAPHY

This application is based on patent application Ser. Nos. 09-71851 and 09-72001 filed in Japan, the contents of which are incorporated herein by reference.

BACKGROUND OF THE INVENTION

1. Field of the Invention

The present invention relates to a liquid developer for electrophotography for use in developing electrostatic latent images in image forming apparatuses such as electrophotographic type copiers, printers and the like.

2. Description of the Related Art

In image formation by an electrophotographic method, an electrostatic latent image is generally formed by the exposure of an image corresponding to a document image on the surface of an electrostatic latent image carrying member such as a photosensitive member or the like, developing said latent image as a visible toner image, and transferring and fixing said toner image on a recording member to produce an image.

Developing methods can be divided into dry-type developing methods and wet-type developing methods.

Dry-type developing methods use colored microparticles (toner) or a carrier having magnetic properties added to a toner. The main components of dry-type toners are normally pigment and a binder resin, with internal and external additives such as charge controller, conduction controllers, plasticizer, separation agents and the like, being added as necessary. Magnetic toners include a magnetic powder such as Fe3O4. In dry-type developing methods, toner is normally charged via contact with a specific surface of the developing device and contact with other toner particles, or in the case of two-component developers containing a carrier, toner is triboelectrically charged through contact of the toner particles and the carrier, as well as ion adsorption, via vacuum ionic discharge, charge injection, electrostatic conduction via electric field, and said toner is transported to the electrostatic latent image region on a latent image carrying member such as a photosensitive member or the like via electrostatic force, mechanical force, magnetic force or the like so as to develop said latent image.

Due to concern that dry-type toners used in dry-type developing will be released into the air via airborne dispersion in the vicinity of the developing device, such toners cannot be made too fine and typically have a mean particle size of several microns to about 10 $\mu$m. Dry-type toners do not produce high resolution images due to their relative large particle size.

On the other hand, the most widely used developer in wet-type developing methods is developer including fine colored particles (toner) mainly comprising pigment and binder resin which is dispersed in an electrically insulated medium (carrier fluid). Charging of the toner is accomplished via charging by the binder resin itself, or ion adsorption via a charge controller when such charge controller is added to the colored fine particles and carrier liquid, such that the charged toner accomplishes; development via the principle of electrophoresis.

Toners used in wet-type developing can be used with a mean particle size in the submicron range because there is no concern of airborne dispersion. Therefore, wet-type developers are advantageous inasmuch as they produce high resolution images having excellent halftone characteristics.

In liquid developers used in wet-type developing, important factors include that the binder resin does not affect toner image transfer characteristics, fixing characteristics, coloration, nor affect toner particle chargeability and dispersion characteristics. Chargeability and dispersion characteristics of the toners used in wet-type developers influence developing characteristics and transfer characteristics when using electrostatic transfers.

For example, Japanese Laid-Open Patent Application No. 50-10140 discloses a liquid developer having improved toner image transfer characteristics and fixing characteristics as well as improved toner particle dispersibility and chargeability by using a toner particle comprising a pigment coated by a binder resin comprising semi-soluble graft copolymer produced by copolymerization reaction of an insoluble monomer and a soluble monomer, said toner particles being dispersed in an organic hydrocarbon solvent used as a carrier fluid.

It is difficult, however to control each of the various characteristics such as fixing characteristics, chargeability, and dispersion characteristics to attain the optimum conditions for each characteristic when using a single such binder resin. It is furthermore difficult to maintain such characteristics at their initial levels after repeated image formations wherein concentrated toner replenishment liquid is resupplied over a long period because the individual characteristics cannot be separately maintained by the resupplied toner.

Therefore, it is desirable that transfer characteristics, fixing characteristics, and toner particle chargeability and dispersibility are controlled by separate materials. Specifically, transfer characteristics and fixing characteristics can be stabilized by using as a binder resin a resin which is insoluble in an organic hydrocarbon solvent used as a carrier fluid, and toner particle chargeability and dispersion characteristics can be controlled by adding a separate charge controller. For example, U.S. Pat. No. 5,407,771 discloses a liquid developer using a thermoplastic resin such as ethylene-vinyl acetate copolymer or the like as a binder resin which is insoluble in an organic hydrocarbon solvent.

This binder resin affects light transmittancy of the image after fixing, however. Particularly in the case of full color images formed by overlaying developers of a plurality of colors, the image is darkened when the resin light transmittance is poor, thereby making it difficult to obtain a desired color. The ethylene-vinyl acetate copolymer resin disclosed in the aforesaid U.S. Pat. No. 5,407,771 has poor resin light transmittance in toner images fixed on a recording member, thus making it difficult to obtain suitable color levels when forming color images.

In order to attain stable transfer characteristics and fixing characteristics as well as excellent light transmittance in a liquid developer, it is desirable to select from among thermoplastic resins a well known saturated polyester resin for use as a binder resin in a color toner for use in dry-type developing. Polyester resin not only allows the changing of physical characteristics such as thermal characteristics within a wide range, but also provides beautiful color due to excellent light transmittance when making full color images, and provides excellent adhesion characteristics relative to recording members such as paper and the like due to the toughness of the resin layer after fixing due to its excellent elasticity and flexibility. Liquid developers using such polyester resin as a binder resin are disclosed in Japanese Laid-Open Patent Applications Nos. 7-92742 and 8-220813.

From the perspective of producing high resolution images, wet-type developing methods are finding increased usefulness in high-speed full color printers in place of dry-type printers, and image formation at ever higher speeds is sought.

Regarding this point, the polyester resin disclosed in, for example, Japanese Laid-open Patent Application No. 7-92742 allows only a maximum system speed of about 400 mm/sec when used as a toner binder resin in a liquid developer. This limitation is believed to be due mainly to low developing speed caused by the low amount of charge of the toner particles. Since fixing cannot overtake the system speed, poor fixing readily occurs. This limitation is believed to be caused mainly by excessive fixing, temperature.

When the toner particles have too high a charge, the liquid developer generally becomes unstable, making it difficult to achieve stable image formation over a long period of time.

When the toner fixing temperature is too low, the liquid developer becomes unstable due to the binder resin used to form the toner readily eluting in the carrier liquid, thereby making it difficult to maintain stable image formation over a long time period.

OBJECTS AND SUMMARY

An object of the present invention is to provide a liquid developer for electrophotography using a polyester resin as a toner binder resin, which can be used in high speed developing and which has excellent stability over time.

A further object of the present invention is to provide a liquid developer for electrophotography using a polyester resin as a toner binder resin, which can be used in high-speed fixing and which has excellent stability over time.

The present invention attains the aforesaid objects by providing a liquid developer for electrophotography comprising colored particles dispersed in an electrically insulated liquid medium, wherein an oil-soluble ionic surface active agent is included as a charge controller in the liquid medium, and the colored particles contain a polyester resin having an acid value of 40 mgKOH/g or higher but less than or equal to 100 mgKOH/g as a binder resin.

The present invention also attains the aforesaid objects by providing a liquid developer for electrophotography comprising colored particles dispersed in an electrically insulated liquid medium, wherein an oil-soluble ionic surface active agent is included as a charge controller in the liquid medium, and the colored particles contain a polyester resin having a glass transition temperature (hereinafter referred to as "Tg") of 35° C. or higher but less than or equal to 65° C. as a binder resin.

BRIEF DESCRIPTION OF THE DRAWINGS

These and other objects and features of the present invention will become apparent form the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Figure 1:
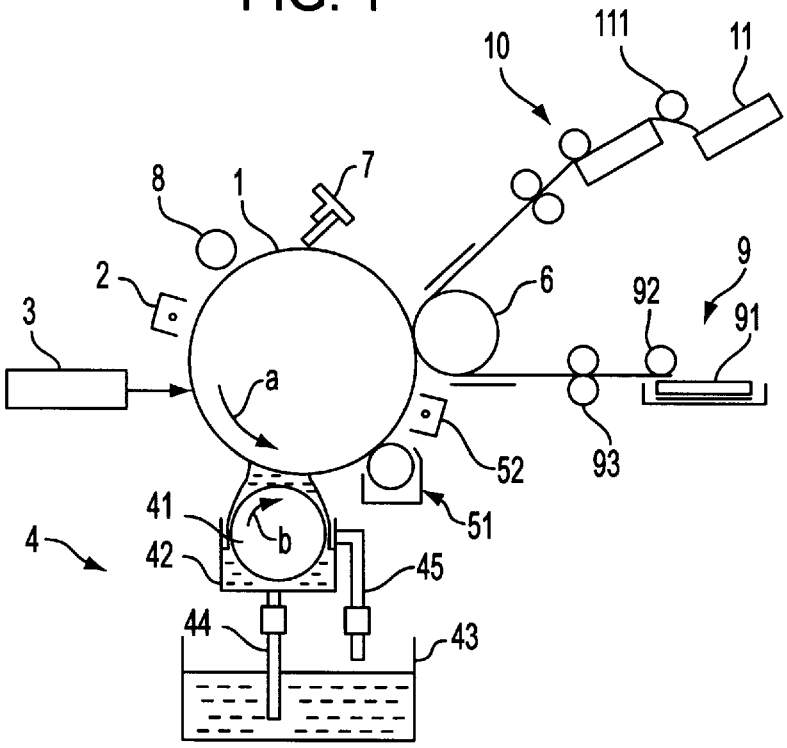
FIG. 1 briefly shows the construction of an example of an image forming apparatus.

Desirable embodiments of the liquid developer for electrophotography of the present invention will comprise at least a toner including a polyester resin having an acid value of 40 mgKOH/g or higher but less than or equal to 100 mgKOH/g as a binder resin, and a carrier including an oil-soluble ionic surface active agent as a charge controller.

Acid value is measured under the conditions disclosed in JIS K5400, the entire contents of which is incorporated herein by reference.

Since desirable embodiments of the liquid developer for electrophotography of the present invention will use a polyester resin having a relatively high acid value of 40 mgKOH/g or higher but less than or equal to 100 mgKOH/g as a toner binder resin, the toner particles will have a large charge to allow high speed developing and a high system speed of a maximum of about 800 mm/sec When the acid value is less than 40 mgKOH/g, it is difficult to improve the system speed, whereas when the acid value exceeds 100 mgKOH/g, it is difficult to manufacture the polyester resin in a state which maintains a specific molecular weight. When the acid value of the binder resin is high, various characteristics of the liquid developer become unstable, although the liquid developer can be maintained stable over time by using an oil-soluble surface active agent as a charge controller.

Since desirable embodiments of the liquid developer for electrophotography of the present invention will control transfer characteristics and fixing characteristics via the binder resin, and additionally control chargeability and dispersibility via the charge control agent, each of the various characteristics can be individually controlled at an optimum condition. Since polyester resin having excellent light transmittance is used as the binder resin, suitable coloration for color image formation can readily be obtained.

Since desirable embodiments of the liquid developer for electrophotography of the present invention will use polyester resin having a relatively low glass transition temperature Tg of 35° C. or higher but less than or equal to 65° C. as a binder resin, the fixing speed can be increased to attain a high-speed system speed of a maximum of about 800 mm/sec When the glass transition temperature Tg exceeds 65° C., it is difficult to improve the system speed, and when Tg is less than 35° C., the material becomes thermally unstable so as to readily cause deformation of the toner particles and fluctuation in the amount of toner charge. Although various characteristics of the liquid developer become unstable due to elution of the binder resin in the carrier fluid when the glass transition temperature Tg of the binder resin is low, the liquid developer can maintain stability over time by using an oil-soluble ionic surface active agent as a charge controller.

The glass transition temperature Tg is measured by differential scanning calorimeter.

Desirable embodiments of the liquid developer for electrophotography of the present invention can be manufactured as described below.

First, a binder resin and colorant are kneaded by, for example, a tri-roller kneading device or the like to disperse the colorant in the binder resin.

Although not limited to the following materials, examples of usable colorants are mentioned below. A typical black color colorant is carbon black. In the case of negative charging toner, carbon subjected to an oxidation process is particularly effective since acidic carbon is a colorant that has strong negative chargeability and that possesses polar groups, such as COOH, OH, C═O and the like, on the surface.

Examples of useful colorants for colors other than black include yellow pigment, magenta pigment, and cyan pigment. Color image formation is accomplished basically by subtractive color mixture using said pigments. Examples of useful yellow pigments include representative diazo yellow pigments such as color index (CI) pigment yellow 12, 13, 14, 17, 55, 81, 83 and the like. Examples of useful magenta pigments include azo lake magenta pigments such as CI pigment red 48, 57 (carmine 6B), 5, 23, 60, 114, 146, 186 and the like, insoluble azo magenta pigments, thioindigo magenta pigment, and quinacridone magenta pigment such as CI pigment red 122, 209 and the like. Examples of useful cyan pigments include copper phthalocyanine blue cyan pigment such as CI pigment blue 15:1, 15:3 and the like.

The additive amount of colorant relative to binder resin is desirably about 5~20 parts-by-weight (hereinafter abbreviated to "pbw") relative to 100 m pbw resin. Furthermore, the resin itself may be used as a colorant.

Such polyester resin is a thermoplastic resin and can be produced by polymerization reaction of polyvalent alcohol and polyvalent basic acid (polyvalent carboxylic acid).

Examples of useful polyvalent alcohols include but are not limited to ethylene glycol, diethylene glycol, triethylene glycol, propylene glycols such as 1,2-propylene glycol and the like, dipropylene glycol, butane diols such as 1,4-butane diol and the like, neopentyl glycol, alkylene glycols (aliphatic glycols) such as hexane diols , e.g., 1,6-hexane diol, alkylene oxides thereof, bisphenol-A, bisphenols such as hydrogen-added bisphenol and the like, phenol glycols of alkylene oxides thereof, aliphatic and aromatic diols such as monocyclic or polycyclic diols, glycerin, triols such as trimethylolpropane and the like. These examples may be used individually or in combinations of two or more.

Particularly desirable materials include 2~3 molar alkylene oxide adduct of neopentylglycol and bisphenol-A, which are preferred from the standpoint of suitability as a toner binder resin in a liquid developer relative to stability and solubility of the raw polyester resin, as well as inexpensiveness. Examples of useful alkylene oxides include ethylene oxide and propylene oxide.

Examples of useful polyvalent basic acids (polyvalent carboxylic acid) include but are not limited to malonic acid, succinic acid, adipic acid, azelaic acid, sebacic acid, fumaric acid, maleic acid, itaconic acid, phthalic acid, and modified acids thereof (e.g., hexahydrophthalic anhydride), saturated and unsaturated bivalent basic acids such as isophthalic acid, terephthalic acid and the like, saturated polyvalent basic acids having three functional groups such as trimellitic acid, tritrimesic acid, pyromellitic acid, and the like, as well as acid anhydrides and low molecular weight alkyl esters thereof. These materials may be used individually or in combinations of two or more.

Isophthalic acid and terephthalic acid are particularly desirable from the standpoint of suitability as a toner binder resin in a liquid developer relative to stability and solubility of the raw polyester resin, as well as inexpensiveness.

Well known condensation polymerization methods may be used as the condensation polymerization method. Although the method may vary according to the raw monomers used, in general the following methods are suitable.

In general the reaction is accomplished at a temperature of about 150~300° C. Various conditions of the reaction are optional such as using an inactive gas as the atmosphere, using various types of solvents, and using a reaction chamber at normal pressure or low pressure. An esterified catalyst may be used to accelerate the reaction.

Examples of useful esterified catalysts include metallic organic compounds such as tetrabutylzirconate, zirconium naphthalate, tetrabutyltitanate, tetraoctyltitanate and 3/1 tin oxalate/sodium acetate. Colorless raw esters are desirable. Alkylphosphate, allyl phosphate and the like may be used as catalysts or color regulating agents.

The polymerization temperature, reaction system pressure, reaction time and the like may be regulated so as to control the molecular weight of the polyester resin product. The suitable molecular weight and molecular number of the resin product of the present invention is the following:

$3{,}000 \leqq Mw \leqq 10{,}000$ and $1{,}500 \leqq Mn \leqq 5{,}000$.

Furthermore, the acid value can be controlled via the molar ratio of the reacting carboxylic acid and alcohol, molecular weight of the polymers and the like.

Other than polyester resin, the binder resin may be constructed using as necessary styrene-acrylic copolymer resin, styrene-acrylic modified polyester resin, polyolefin copolymer (particularly ethylene copolymer), epoxy resin, rosin modified phenol resin, rosin modified maleic acid resin, paraffin wax and like resins optimally combined within a range of less than 30 percent-by-weight (hereinafter abbreviated to "wt %") of total weight of the resin.

The colored kneaded material comprising the obtained binder resin and added colorant as necessary is coarsely pulverized using a cutter mill, jet mill or the like. The coarsely pulverized material is subjected to a wet-type grinding process in a small amount of carrier fluid in which is dissolved a charge control agent. The ground material is then finely pulverized to attain a toner having a volume-average particle size of about 0.1~10 $\mu$m, and preferably about 0.5~5 $\mu$m, in the form of a concentrated liquid developer. The thus obtained concentrated liquid developer may then be diluted to a suitable concentration via a dispersion process using a carrier fluid containing charge controller, dispersion agent (dispersion stabilizer) and like additives.

When the volume-average particle size of the toner particles is less than 0.1 $\mu$m, the force of the electric field is weakened during developing due to the low $\xi$-potential, thereby reducing the developing speed. Electrostatic transfer is difficult due to the requirement of a high electric field. When the volume-average particle size of the toner particles exceeds 10 $\mu$m, high resolution images are difficult to obtain.

The carrier fluid has a resistance value which will not disturb the latent image (i.e., about $10^{11}$~$10^{16}$ $\Omega$cm). The carrier fluid may assume any state at room temperature insofar as it is in a liquid state when the temperature is elevated above the softening point of the dispersed resin. It is desirable that the boiling point of the carrier fluid be such that allows for easy drying after fixing. It is further desirable that the carrier fluid be a solvent which is odorless and nontoxic, and has a relatively high ignition point.

Examples of useful carrier fluids include aliphatic hydrocarbons, alicyclic hydrocarbons, aromatic hydrocarbons, halogenated hydrocarbons, polysiloxane and the like. Particularly desirable from the perspectives of odor, nontoxicity, and cost are normal paraffin solvents, and isoparaffin solvents. Specifically, isobar-G, isobar-H, isobar-L, isobar-K (Exxon Chemicals), Shellsol 71 (Shell Oil Co.), IP solvent 1620, IP solvent 2028 (Idemitsu Sekiyu). Paraffins and waxes which are solid at room temperature may be used. When using paraffins and waxes which are solid at room temperature, it is desirable that they be heated to a liquid state prior to addition to the liquid developer.

Charge controller is actually dissolved or solvated in the carrier fluid, and is added to the carrier fluid for the purpose of influencing the charging characteristics of the toner particles. Charge controller also may be added to the toner particles as necessary.

Oil-soluble surface active agents usable as charge controllers will typically include as a main component alkylallylsulfonate having an alkyl group of 20 or more carbon atoms. Specific examples include alkylbenzenesulfonate having alkyl group of 20 or more carbon atoms (calcium salts, barium salts and the like), petroleum sulfonate (barium salts, calcium salts, magnesium salts), basic petroleum sulfonate (barium salts, calcium salts, magnesium salts) and the like.

Most effective among the aforesaid materials are petroleum sulfonate (barium salts, calcium salts), and basic petroleum sulfonate (barium salts, calcium salts).

Specific commercial products which are usable as the aforesaid charge controllers include Sulfol Ca-45N, Sulfol Ca-45, Sulfol 1040, Molescoomber SC-45N, Molescoomber SC-45, Sulfol Ba-30N, Molescoomber SB-50N (Matsumura Sekiyu Kenkyijo), Basic Barium Petronate, Neutral Barium Petronate, Basic Calcium Petronate, Neutral Calcium Petronate, Basic Magnesium Petronate (Witco Chemical Co.) and the like.

The aforesaid charge controllers may be used singly or in combinations of two or more. Although the amount of added charge controller will differ depending on the type, it is desirable that it be added at a rate of about 0.01~5 wt % relative to the carrier fluid. It is further desirable that the charge controller is added at a rate of about 0.01~50 wt % relative to the toner.

Dispersion agent (dispersion stabilizer) may be used to stabilize the dispersion of toner particles within the liquid developer. A polymer which adheres to the toner particles, and has an affinity for the carrier fluid so as to be soluble, semi-soluble, or have a swelling tendency therein may be used as a dispersion agent (dispersion stabilizer).

Although polymers which are soluble, semi-soluble or have a swelling tendency are not specifically limited, polyolefin petroleum resins, linseed oil, polyalkylmethacrylate and the like may be used, and material produced by copolymerization of monomers having a polar group such as methacrylate, acrylate, alkylaminoethylmethacrylate and the like may be used to increase the affinity with the toner particles. In this instance, it is possible to control solubility in the carrier fluid, as well as affinity for and adhesion to the toner particles via the amount of the polar groups being copolymerized, such that as the amount of the polar groups increases, the solubility in the carrier fluid decreases, and the affinity for and adhesion to the toner particles increase.

It is desirable, from the standpoint of preventing an increase in viscosity of the carrier fluid via the addition of agents to improve dispersibility, that the dispersion agent is added at a rate of about 0.01~20 wt % relative to the carrier fluid. Even more desirable is the addition a rate of about 0.1~10 wt %.

It is desirable that the percentage (solid ratio) of total weight of solid components such as toner, charge controller, dispersion agent and the like is about 1~90 wt % relative to the total weight of the liquid developer. It is even more desirable that the solid ratio is set at 2~50 wt % for ease of handling as the total amount of liquid developer is reduced during development.

The density of the toner relative to the carrier fluid is desirably 0.5~50 wt %, and preferably 2~10 wt %, from the perspective of developing speed and avoiding image fog and the like. This density is the density during developing. The density during storage, replenishment, and transport of the toner is not specifically limited.

Although the present invention is described by way of specific examples hereinafter, it is to be noted that the present invention is not limited to these examples. In the following description, "parts" refers to parts-by-weight unless otherwise specified, "Tg" refers to glass transition temperature, "Mw" refers to weight-average molecular weight, and "Mn" refers to number-average molecular weight.

In the following examples, acid value was measured under the conditions disclosed in JIS K5400. Tg was measured using a differential scanning calorimeter Model DSC-20 (Seiko Electronics) using a 35 mg specimen, and a temperature rise speed of 10° C./min.

Mw and Mn were calculated from the results obtained by gel permeation chromatography. Gel permeation chromatography was accomplished using a high-speed liquid chromatography pump Model TRI ROTAR-V (Nippon Bunko K. K.), ultraviolet spectrometer Model UVIDEC-100-V (Nippon Bunko K. K.), and a 50 cm column Model Shodex GPC A-803 (Showa Denko K. K.). Molecular weight of the specimen was calculated using polystyrene as a standard material to determine the styrene conversion Mw and Mn. Specimens comprised 0.05 g binder resin dissolved in 20 ml tetrahydrofuran (THF).

Production of Polyester Resins

The acid value of the polyester resin of the present invention can be controlled by controlling the degree of polymerization and the ratio of acid component and alcohol component.

(1) Polyester Resin 1

To a round-bottom flask equipped with a reflux condenser, water/alcohol separator, nitrogen gas tube, thermometer, and mixing device were added 1700 parts bisphenol-A polypropylene oxide adduct (polyvalent alcohol), and 890 parts isophthalic acid (polyvalent basic acid). Nitrogen gas was introduced to the flask as the materials were mixed, and dehydration polycondensation and dealcoholation polycondensation were accomplished at 200~240° C. When the acid value of the raw polyester resin and the viscosity of the reaction fluid attained predetermined values, the reaction system was cooled to less than 100° C. to stop the reaction to obtain thermoplastic polyester resin 1.

The obtained polyester resin 1 had a weight-average molecular weight Mw=5050, a number-average molecular weight Mn=2550, a glass transition temperature Tg=54.9° C., and an acid value of 45.2 mgKOH/g.

(2) Polyester Resin 2

Thermoplastic polyester resin 2 was produced in the same manner as polyester resin 1 with the exception that 1450 parts bisphenol-A propylene oxide and 1090 parts isophthalic acid were used as raw materials.

The obtained polyester resin 2 had a weight-average molecular weight Mw=3900, a number-average molecular weight Mn=1950, a glass transition temperature Tg=45.1° C., and an acid value of 75.0 mgKOH/g.

(3) Polyester Resin 3

Thermoplastic polyester resin 3 was produced in the same manner as polyester resin 1 with the exception that 1650 parts bisphenol-A propylene oxide and 800 parts isophthalic acid were used as raw materials.

The obtained polyester resin 3 had a weight-average molecular weight Mw=4500, a number-average molecular weight Mn=2700, a glass transition temperature Tg=40.3° C., and an acid value of 34.9 mgKOH/g.

(4) Polyester Resin 4

To a round-bottom flask equipped with a reflux condenser, water/alcohol separator, nitrogen gas tube, thermometer, and mixing device were added 800 parts bisphenol-A ethylene oxide adduct, and 1700 parts isophthalic acid. Nitrogen gas was introduced to the flask, and dehydration polycondensation and dealcoholation polycondensation were accomplished at 200~240° C. The acid value and liquid viscosity were monitored, and the reaction system temperature was cooled to less than 100° C. to stop the reaction. The obtained polyester resin 4 had a weight-average molecular weight Mw=3800, a number-average molecular weight Mn=1750, a glass transition temperature Tg=40.1° C., and an acid value of 101.0 mgKOH/g.

Production of Liquid Developer

Liquid Developer 1 (Example 1)(Wet-type Pulverization)

A mixture of 60 pbw polyester resin 1 and 40 pbw carbon black Mogul-L (Cabot) was kneaded for 4 hr at 180° C. using a tri-roller kneading device to obtain a high-density pigment kneaded material. This high-density pigment kneaded material was diluted by the aforesaid polyester resin 1 using a kneader, to obtain a colored resin kneaded material having an ultimate carbon black density of 15 wt %. After this colored resin kneaded material was thoroughly cooled, it was coarsely pulverized using a cutter mill, then finely pulverized using a jet mill (Nippon Pneumatic) to obtain colored toner particles having a mean particle size of about 10 μm. To 70 g of IP Solvent 1620 (Idemitsu Sekiyu Kagaku) containing 0.5 wt % petroleum barium sulfonate Sulfone Ba-30N (Matsumura Sekiyu Kenkyujo) was added 30 g of the aforesaid toner particles and the material was mixed, and subjected to wet grinding using a sand grinder (Igarashi Kikai Seizo Co., Ltd.) and 1 mm diameter glass beads (150 cc) as media for 15 hr at disk speed of 2000 rpm and cooling water temperature of 20° C. in a ⅛ gallon vessel provided with a water jacket to obtain concentrated liquid developer having a volume-average toner particle size of 1.45 μm.

To 100 parts of the aforesaid concentrated liquid developer was added 900 parts IP Solvent 1620 containing 0.5 wt % petroleum barium sulfonate Sulfone Ba-30N to dilute the developer, and the material was subjected to a dispersion process using a model TK autohomo mixer M (Tokyu Kikai Co., Ltd) for 5 min at 10,000 rpm to obtain liquid developer 1.

Liquid Developer 2 (Example 2) (Wet-type Pulverization)

Liquid developer 2 was produced in the same manner as liquid developer 1 with the exception that polyester resin 2 was substituted for polyester resin 1, and the obtained toner particles had a volume-average particle size of 1.46 μm.

Liquid Developer 3 (Example 3) (Emulsion-dispersion-granulation)

100 parts polyester resin 1 was completely dissolved in ethylene chloride to attain 20 wt %, and 15 parts carbon black Mogul-L (Cabot) was added and dispersed as a colorant using an Eiger motor mill (Eiger Japan) to obtain colored resin liquid.

This colored resin liquid was emulsified and dispersed in an aqueous solution containing 1 wt % Metrose 65SH-50 (Tokusyukikou-Kogyo-Sha) and 1 wt % sodium lauryl sulfate using a dispersion device model Robomics (Tokyu Kikai Kigyo) for 20 min at 10,000 rpm to obtain and oil-in-water type (O/W) emulsion. This emulsion dispersion was accomplished at room temperature. Then, a 4-bladed mixing attachment was installed in the dispersion device, and the material was mixed for 3 hr at 40~45° C. to remove the methylene chloride, and obtain an aqueous suspension of toner particles having a volume-average particle size of 1.82 μm.

This aqueous; suspension of toner particles was centrifuged at 10,000 rpm to remove the solids. The obtained solid was placed in a beaker, and distilled water was added to increase the weight about five-fold, then the material was washed for 10 min via an ultrasonic dispersion device, and the suspension was again centrifuged to remove the solids.

After washing, the solids were spread on filter paper for drying by evaporating the moisture at room temperature to obtain resin particles.

20 parts resin particles were placed in a beaker, and 100 parts IP Solvent 1620 containing 0.5 wt % petroleum barium sulfonate Sulfone Ba-30N were added and the material was mixed for 48 hr at 200 rpm and 25° C. using a stirrer.

The slurry mixture was centrifuged at 10,000 rpm for 5 min to remove the solids. The obtained solid were spread on a filter paper and dried at room temperature until the surface was slightly wet to obtain washed resin particles.

To 3 parts of these washed resin particles was added 100 parts IP Solvent 1620 containing 0.5 wt % petroleum barium sulfonate Sulfone Ba-30N. The material was mixed and subjected to a dispersion process for 5 min using an ultrasonic dispersion device to obtain liquid developer 3. This developer contained toner particles having a volume-average particle size of 1.76 μm.

Liquid Developer 4 (Example 4) (Wet-type Pulverization)

Liquid developer 4 was produced in the same manner as liquid developer 1 with the exception that 5.0 wt % barium alkylbenzene sulfonate Molescoomber SB-50N (Matsumura Sekiyu Kenkyujo) was substituted for the 0.5 wt % petroleum barium sulfonate Sulfol Ba-30N as a charge controller added to the IP solvent 1620 containing the colored toner particles, and the charge controller was not added to the IP solvent 1620 used to dilute the concentrated liquid developer. The obtained toner particles had a volume-average particle size of 1.25 μm.

Liquid Developer 5 (Example 5) (Wet-type Pulverization)

Liquid developer 5 was produced in the same manner as liquid developer 1 with the exception that charge controller was not added to the IP Solvent 1620 containing the colored resin particles, and 0.5 wt % basic calcium Petronate Sulfol 1040 (Matisumura Sekiyu Kenkyujo) was substituted for the 0.5 wt % petroleum barium sulfonate Sulfol Ba-30N added to the IP solvent 1620 to dilute the concentrated liquid developer. The obtained toner particles had a volume-average particle size of 2.56 μm.

Liquid Developer 6 (Example 6) (Wet-type Pulverization)

Liquid developer 6 was produced in the same manner as liquid developer 1 with the exception that Basic barium Petronate (Witco Chemical Co.) was substituted for the 0.5 wt % petroleum barium sulfonate Sulfol Ba-30N as a charge controller added to the IP solvent 1620 used as a charge controller. The obtained toner particles had a volume-average particle size of 1.41 μm.

Liquid Developer 7 (Comparative Example 1) (Wet-type Pulverization)

Liquid developer 7 was produced in the same manner as liquid developer 1 with the exception that polyester resin 3 was substituted for polyester resin 1, and the volume-average particle size of the obtained toner particles was 1.44 μm.

Liquid Developer 8 (Comparative Example 2) (Wet-type Pulverization)

Liquid developer 8 was produced in the same manner as liquid developer 1 with the exception that 1.0 wt % lecithin (tablet lecithin; Waco Pure Chemical Industries, Ltd.) was substituted for the 0.5 wt % petroleum barium sulfonate Sulfol Ba-30N added to the IP Solvent 1620 as a charge controller, and the volume-average particle size of the obtained toner particles was 1.49 μm.

Liquid Developer 9 (Comparative Example 3) (Wet-type Pulverization)

Liquid developer 9 was produced in the same manner as liquid developer 1 with the exception that polyester resin 2 was substituted for polyester resin 1, and 1.0 wt % lecithin (tablet lecithin; Waco Pure Chemical Industries, Ltd.) was substituted for the 0.5 wt % petroleum barium sulfonate Sulfol Ba-30N added to the IP Solvent 1620 as a charge controller, and the volume-average particle size of the obtained toner particles was 1.49 μm.

Liquid Developer 10 (Comparative Example 4) (Wet-type Pulverization)

Liquid developer 10 was produced in the same manner as liquid developer 1 with the exception that 1.0 wt % N-vinyl-2-pyrrolidone/laurylmethacrylate copolymer A (composition ratio 5:95) was substituted for the 0.5 wt % petroleum barium sulfonate Sulfol Ba-30N added to the IP Solvent 1620 as a charge controller, and the volume-average particle size of the obtained toner particles was 1.42 μm.

Liquid Developer 11 (Comparative Example 5) (Wet-type Pulverization)

Liquid developer 11 was produced in the same manner as liquid developer 1 with the exception that polyester resin 2 was substituted for polyester resin 1, and 1.0 wt % N-vinyl-2-pyrrolidone/laurylmethacrylate copolymer A (composition ratio 5:95) was substituted for the 0.5 wt % petroleum barium sulfonate Sulfol Ba-30N added to the IP Solvent 1620 as a charge controller, and the volume-average particle size of the obtained toner particles was 1.44 μm.

The N-vinyl-2-pyrrolidone/laurylmethacrylate copolymer A (composition ratio 5:95) used to produce the aforesaid liquid developers 10 and 11 was manufactured as described below. 95 g laurylmethacrylate was dissolved in 200 g IP Solvent 1620 (Idemitsu Sekiyu Kagaku), and argon gas was pumped into the solution for 10 min to accomplish argon gas conversion of the entire reaction system. Then, 1 molar % benzoylperoxide (BPO) was added to the lauryl methacrylate monomer as a polymerization initiator and a polymerization reaction was induced for 4 hr at 80° C. After the reaction system was cooled to 30° C., 5 g N-vinyl-2-pyrrolidone monomer was added, and finally 1 molar % azobisisobutylonitrile (AIBN) was added relative to the N-vinyl-2-pyrrolidone monomer and allowed to stand for 4 hr at 90° C. to complete the polymerization. The obtained N-vinyl-2-pyrrolidone/laurylmethacrylate copolymer liquid was designated copolymer A.

Liquid Developer 12 (Comparative Example 6) (Wet-type Pulverization)

Liquid developer 12 was produced in the same manner as liquid developer 1 with the exception that polyester resin 4 was substituted for polyester resin 1, and the obtained toiler particles had a volume-average particle size of 1.46 μm.

Liquid developers 1~12 evaluated for changes in developing speed, and image density and edge effect both before and after 10,000 image formations using the image forming apparatus shown in FIG. 1 and using stability over time as a parameter.

The image forming apparatus shown in FIG. 1 is an electrophotographic type with a built in liquid developing device, and comprises a photosensitive drum 1 around the periphery of which are sequentially arranged a charger 2, image exposure device 3 to generate a laser beam based on image data transmitted from a host computer or the like (not illustrated), liquid developing device 4, squeeze roller device 51, squeeze charger 52, transfer roller 6, cleaner 7, and eraser lamp 8. Provided near transfer roller 6 are paper supply device 9, fixing device 10 including a pair of heat-fixing rollers to fuse a toner image onto a sheet, and discharge tray 11 to accommodate sheets ejected from the printer. Discharge tray 11 is provided with an attached discharge roller 111. Paper supply unit 9 comprises a cassette 91 to internally hold recording sheets, feed roller 92 to feed out sheets from cassette 91 one sheet at a time, and timing roller 93. Liquid developing device 4 comprises a developing roller 41 disposed opposite photosensitive drum 1 with a small gap there between and the bottom portion of which is saturated with liquid developer, developer tray 42 accommodating liquid developer around the periphery of developing roller 41, developer storage tank 43 to store liquid developer to be supplied to liquid developer tray 42, developer supply device 44 to lift developer within developer storage tank 43 to developer tray 42, and developer recovery device 45 to return excess developer within developer tray 42 to developer storage tank 43. The developer within developer storage tank 43 receives concentrated toner replenishment fluid at suitable times via a concentrated toner replenishment device (not illustrated) so as to maintain a nearly constant toner concentration. The developing gap between developing roller 41 and photosensitive drum 1 may be optionally set within a range of 0~2 mm.

Image formation is accomplished by rotating photosensitive drum 1 at a speed of 80 cm/sec (=800 mm/sec) in the direction of arrow a in the drawing, and uniformly charging the surface of photosensitive drum 1 via charger 2 to attain a surface potential of about −500 V. Then, a laser beam emitted from image exposure unit 3 based on image data irradiates the surface of photosensitive drum 1 so as to form an electrostatic latent image thereon. The exposure surface area on the surface of photosensitive drum 1 comprises about 30% of the total surface area of photosensitive drum 1. Therefore, the surface potential of photosensitive drum 1 decays to about −30 V.

The electrostatic latent image formed on the surface of photosensitive drum 1 is developed by liquid developing device 4 using liquid developer so as to render the image visible. Developing roller 41 is rotated at a speed of 120 cm/sec (=1200 mm/sec) in the direction of arrow b in the drawing, i.e., in the opposite direction to the rotation of photosensitive drum 1, and the developing gap formed between photosensitive drum 1 and developing sleeve 41 is set at 100 μm. A bias voltage of about −400 V is supplied to developing sleeve 41 to promote adhesion of the developer at the exposure region and suppress adhesion of the developer at the non-exposure region.

Thereafter, excess liquid developer adhered to the surface of photosensitive drum 1 is squeezed by squeeze charger 52 and squeeze roller 51 rotating in the same direction as photosensitive drum 1, such that a toner image in a slightly liquid state is formed on the surface of photosensitive drum 1. This toner image is directly rotated to a transfer position opposite the transfer roller 6, and comes into contact with a sheet transported from paper supply unit 9 so as to be transferred onto said sheet via electrostatic transfer. A transfer voltage of about +1,000 V is supplied to transfer roller 6.

After the transfer sheet is separated from photosensitive drum 1, it is transported to fixing device 10 provided with a pair of heat-fixing rollers heated to 150° C., such that the toner image is fused onto said sheet via heat and pressure. Since image formation on the transfer sheet is completed, the sheet is then ejected onto discharge tray 11 via discharge roller 111. Subsequently, the residual liquid developer remaining on the surface of photosensitive drum 1 is removed therefrom by cleaner 7, and the residual charge remaining on the surface of photosensitive drum 1 is removed via eraser lamp 8 in preparation for the next image formation.

The developing speed of the apparatus shown in FIG. 1 was evaluated in the following manner.

The rotational speed of photosensitive drum 1 was varied within a predetermined time range from 100 mm/sec to 1000 mm/sec, and rate of change of the image densities produced by the liquid developers of the examples and comparative examples were measured using a model PDM5 densitometer (Sakura).

At rotational speeds of 100 mm/sec to 1000 mm/sec, a rate of reduction in image density of less than 10% was designated A (good), reduction of 10% or greater but less that 15% was designated B (satisfactory), reduction of 15% or greater was designated C (unsatisfactory).

During evaluations, the rotational speed of the developing roller 41 was set at 1.5 times the rotational speed of the photosensitive drum 1.

Evaluations of image density, and edge effect stability were evaluated in the following manner using the apparatus of FIG. 1.

A band-like electrostatic latent image 20 cm in length on the lengthwise direction of the photosensitive drum 1 and 5 cm in length in the circumferential direction of the drum was formed on drum 1, and this latent was developed to obtain a band-like developed image measuring 20×5 cm. This process was repeated 10,000 times to maintain a nearly constant toner concentration within developer storage tank 43 and developer tray 42. The reflection density was measured at three points including the center area and 5 cm from the bilateral edges of the band-like image using a model PDM5 densitometer (Sakura) to determine an average value, and image density stability and liquid developer stability were evaluated by comparing the mean reflection densities before and after 10,000 image formations. A mean reflection density of 2 or higher was designated good, a density of 1.8 but less than 2 was designated satisfactory, and a density of less than 1.8 was designated unsatisfactory.

Furthermore, the ratio of the reflection density at the center area and the highest reflection density at either side 5 cm from the edge of the band-like image was determined (edge ratio=edge reflective density/center reflective density), and edge effect stability and liquid developer stability were evaluated by comparing the edge ratios before and alter 10,000 image formations. An edge ratio of less than 1.2 was designated good, a ratio of more than 1.2 but less than 1.5 was designated satisfactory, and a ratio of 1.5 or higher was designated unsatisfactory.

Figure 2:
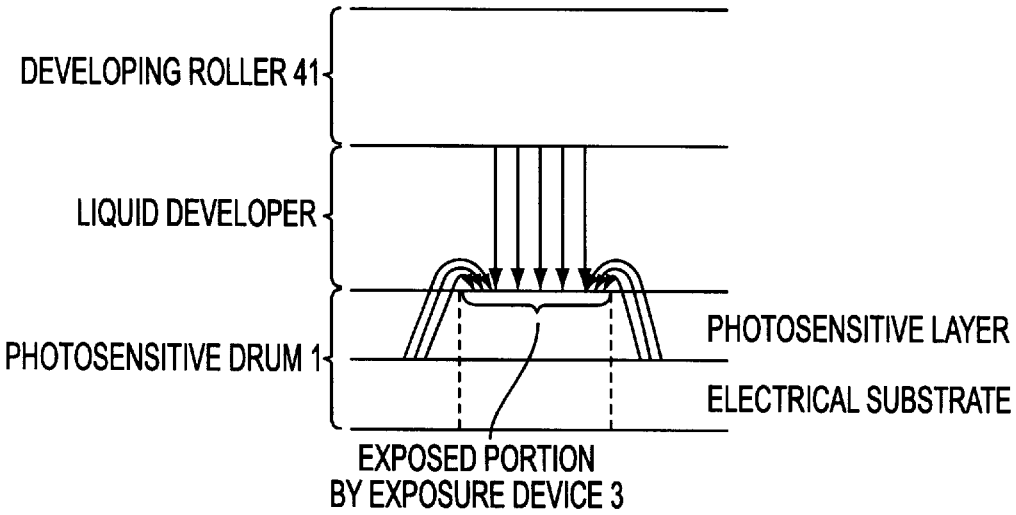
FIG. 2 illustrates the edge effect in developing when using a liquid developer.

Edge effect is a phenomenon which is described below. In the developing region between the latent image carrying member and developing roller, toner particles migrate electrically via the action of an electric field formed in the developing region, and the electrostatic latent image is developed when the toner particles reach the latent image formed on the latent image carrying member. At this time, the aforesaid electric field has different intensities at the center area and edge areas of the latent image, as shown in FIG. 2, such that the action of the electric field is greater at the edges of the latent image. Therefore, developing is accomplished faster at the edges of the latent image than at the center area of the latent image. For this reason, if the latent image formed on the latent image carrying member passes from the developing region before the center area of the image is adequately developed, the ultimately obtained toner image will have a higher image density at positions corresponding to the edges of the latent image and lower image density at the position corresponding to the center of the latent image, i.e., the so-called "edge effect image." That is, The occurrence of the edge effect is a reflection of the developing speed of the center of the latent image and electric migration of the toner particles.

Results are shown in Table 1 below.

TABLE 1

| | | | | Stability | | | |
|---|---|---|---|---|---|---|---|
| | | | | Image density | | Edge ratio | |
| | Acid value | Charge controller | Developing speed | Start | After 10,000 | Start | After 10,000 |
| Ex 1 | 45.2 | Petroleum Ba sulfonate | A | 2.3 | 2.3 | 1.0 | 1.1 |
| Ex 2 | 75.0 | Petroleum Ba sulfonate | A | 2.5 | 2.4 | 1.0 | 1.0 |
| Ex 3 | 45.2 | Petroleum Ba sulfonate | A | 2.3 | 2.2 | 1.0 | 1.1 |
| Ex 4 | 45.2 | Ba alkylbenzene Petronate | A | 2.3 | 2.1 | 1.0 | 1.1 |
| Ex 5 | 45.2 | Basic Ba Petronate | A | 2.3 | 2.2 | 1.0 | 1.1 |
| Ex 6 | 45.2 | Basic Ba Petronate | A | 2.3 | 2.0 | 1.0 | 1.1 |
| CE 1 | 34.9 | Petroleum Ba sulfonate | C | 2.2 | 1.0 | 1.0 | 1.6 |
| CE 2 | 45.2 | Lecithin | B | 1.9 | 1.5 | 1.3 | 1.3 |
| CE 3 | 75.0 | Lecithin | A | 2.0 | 1.5 | 1.2 | 1.9 |
| CE 4 | 46.2 | N-vinyl-2-pyrrolidone/ lauryl methacrylate copolymer | B | 1.9 | 1.5 | 1.3 | 2.0 |
| CE 5 | 75.0 | N-vinyl-2-pyrrolidone/ lauryl methacrylate copolymer | A | 1.9 | 1.4 | 1.2 | 1.9 |
| CE 6 | 101.0 | Petroleum Ba sulfonate | A | 2.5 | 1.5 | 1.0 | 1.8 |

It can be understood from Table 1 that liquid developers having an acid value of less than 35 (Comparative Example 1) were not capable of a developing speed suitable for high speed systems. It can be further understood that higher developing speeds can be realized with high acid values.

On the other hand, when high acid value polyester resin and oil soluble ionic surface active agents were used (Examples 1~6), stable images were produced even after long term use. In contrast, when other charge controllers were used (Comparative Examples 2~5), images deteriorated markedly after long term use.

Although the reasons for this difference are unclear, resins with a high acid value are primarily unstable substances and are readily swollen by the carrier fluid or fuse to other resin particles, suggesting that the reason for said difference may be that the oil-soluble ionic surface active agent coats the resin so as to obstruct the aforesaid swelling and fusion.

Excellent stability cannot be obtained, however, when the acid value exceeds a predetermined value, i.e., greater than 100 mgKOH/g (Comparative Example 6). This finding suggests that stability of the resin and the like is difficult to maintain when the acid value is too high.

It can be understood that the liquid developers of Examples 1~6 of the present invention using polyester resin having an acid value of 40 mgKOH/g and greater but less than 100 rrgKOH/g as a binder resin and an oil-soluble ionic surface active agent as a charge controller were quite stable and produced excellent image density and edge effect before and after 10,000 image formations.

The liquid developer of Comparative Example 1 using a polyester resin having an acid value 34.9 mgKOH/g as a binder resin produced excellent edge effect during initial image formations, but was unstable and produced unsatisfactory edge effect after 10,000 image formations. Liquid developers of Comparative Examples 2 and 3 using the ampholytic surface active agent lecithin as a charge control agent and the liquid developers of Comparative Examples 4 and 5 using nonionic N-vinyl-2-pyrrolidone/laurylmethacrylate copolymer as a charge control agent produced excellent image density and edge effect at initial image formations, but were unstable and unsatisfactory after 10,000 image formations.

Thus, providing for an acid value within the range of the present invention in a liquid developer for electrophotography using a polyester resin as a binder resin can provide a liquid developer for electrophotography capable of withstanding fast developing speed and having excellent stability over time.

Investigations into changing the glass transition temperature Tg are described below.

The glass transition temperature Tg of the polyester resin of the present invention can be controlled, for example, by controlling the degree of polymerization, in which case the melt viscosity is monitored during the manufacturing process.

Production of Polyester Resin (1b) Polyester Resin 1b

To a round-bottom flask equipped with a reflux condenser, water/alcohol separator, nitrogen gas tube, thermometer, and mixing device were added 1600 parts bisphenol-A polypropylene oxide adduct (polyvalent alcohol), and 890 parts isophthalic acid (polyvalent basic acid). Nitrogen gas was introduced to the flask as the materials were mixed, and dehydration polycondensation and dealcoholation polycondensation were accomplished at 200~240°C. When the acid value of the raw polyester resin and viscosity of the reaction fluid attained predetermined values, the reaction system was cooled to less than 100° C. to stop the reaction to obtain thermoplastic polyester resin 1b.

The obtained polyester resin 1b had a weight-average molecular weight Mw=7700, number-average molecular weight Mn=3800, glass transition temperature Tg=60.3° C., and acid value of 24.0 mgKOH/g.

(2b) Polyester Resin 2b

Thermoplastic polyester resin 2b was produced in the same manner as polyester resin 1b with the exception that 1750 parts bisphenol-A propylene oxide and 690 parts isophthalic acid were used as raw materials.

The obtained polyester resin 2b had a weight-average molecular weight Mw=3500, number-average molecular weight Mn=1950, glass transition temperature Tg=35.1° C., and acid value of 15.8 mgKOH/g.

(3b) Polyester Resin 3b

Thermoplastic polyester resin 3b was produced in the same manner as polyester resin 1b with the exception that 1500 parts bisphenol-A propylene oxide and 890 parts isophthalic acid were used as raw materials.

The obtained polyester resin 3b had a weight-average molecular weight Mw=9200, number-average molecular weight Mn=4350, glass transition temperature Tg=74.9° C., and acid value of 19.8 mgKOH/g.

(4b) Polyester Resin 4b

To a round-bottom flask equipped with a reflux condenser, water/alcohol separator, nitrogen gas tube, thermometer, and mixing device were added 1750 parts bisphenol-A ethylene oxide adduct, and 690 parts isophthalic acid. Dehydration polycondensation and dealcoholation polycondensation were accomplished at 200~240° C. under a nitrogen atmosphere.

The acid value and liquid viscosity were monitored, and the reaction system temperature was cooled to less than 100° C. to stop the reaction. The obtained polyester resin 4b had a weight-average molecular weight Mw=3450, number-average molecular weight Mn=1900, glass transition temperature Tg=33.1° C., and acid value of 17.8 mgKOH/g.

Production of Liquid Developer

Liquid Developer 1b (Example 1b)(Wet-type Pulverization)

A mixture of 60 pbw polyester resin 1b and 40 pbw carbon black Mogul-L (Cabot) was kneaded for 4 hr at 180° C. using a tri-roller kneading device to obtain a high-density pigment kneaded material. This high-density pigment kneaded material was diluted by the aforesaid polyester resin 1b using a kneader, to obtain a colored resin kneaded material having an ultimate carbon black density of 15 wt %. After this colored resin kneaded material was thoroughly cooled, it was coarsely pulverized using a cutter mill, then finely pulverized using a jet mill (Nippon Pneumatic) to obtain colored toner particles having a mean particle size of about 10 μm. To 70 g of IP Solvent 1620 (Idemitsu Sekiyu Kagaku) containing 0.5 wt % petroleum barium sulfonate Sulfone Ba-30N (Matsumura Sekiyu Kenkyujo) was added 30 g of the aforesaid toner particles and the material was mixed, and subjected to wet grinding using a sand grinder (Igarashi Kikai Seizo Co., Ltd.) and 1 mm diameter glass beads (150 cc) as media for 15 hr at disk speed of 2000 rpm and cooling water temperature of 20° C. in a ⅛ gallon vessel provided with a water jacket to obtain concentrated liquid developer having a volume-average toner particle size of 1.48 μm.

To 100 parts of the aforesaid concentrated liquid developer was added 900 parts IP Solvent 1620 containing 0.5 wt % petroleum barium sulfonate Sulfone Ba-30N to dilute the developer, and the material was subjected to a dispersion process using a model TK autohomo mixer M (Tokyu Kikai Co., Ltd) for 5 min at 10,000 rpm to obtain liquid developer 1b.

Liquid Developer 2b (Example 2b) (Wet-type Pulverization)

Liquid developer 2b was produced in the same manner as liquid developer 1b with the exception that polyester resin 2b was substituted for polyester resin 1b, charge controller was not added to the IP Solvent 1620 used to dilute the concentrated liquid developer, and the obtained toner particles had a volume-average particle size of 1.51 ∞m.

Liquid Developer 3b (Example 3b) (Wet-type Pulverization)

Liquid developer 3b was produced in the same manner as liquid developer 1b with the exception that charge controller was not added to the IP Solvent 1620 containing the colored resin particles, 0.75 wt % barium alkylbenzene sulfonate Molescoomber SB-50N (Matsumura Sekiyu Kenkyujo) was substituted for the 0.5 wt % barium Petronate Sulfol Ba-30N added to the IP Solvent 1620 used to dilute the concentrated liquid developer, and the obtained toner particles had a volume-average particle size of 2.56 μm.

Liquid Developer 4b (Example 4b) (Emulsion-dispersion-granulation)

100 parts polyester resin 1b was completely dissolved in ethylene chloride to attain 20 wt %, and 15 parts carbon black Mogul-L (Cabot) was added and dispersed as a colorant using an Eiger motor mill (Eiger Japan) to obtain colored resin liquid.

This colored resin liquid was emulsified and dispersed in an aqueous solution containing 1 wt % Mietrose 65SH-50 (Tokusyuki Kou-Kogyo-Sha) and 1 wt % sodium lauryl sulfate and 1 wt % sodium lauryl sulfate using a dispersion device model Robomics (Tokyu Kikai Kigyo) for 20 min at 10,000 rpm to obtain and oil-in-water type (O/W) emulsion. This emulsion dispersion was accomplished at room temperature. Then, a 4-bladed mixing attachment was installed in the dispersion device, and the material was mixed for 3 hr at 40~45° C. to remove the methylene chloride, an obtain an aqueous suspension of toner particles having a volume-average particle size of 1.80 μm.

This aqueous suspension of toner particles was centrifuged at 10,000 rpm for 5 min to remove the solids. The obtained solid was placed in a beaker, and distilled water was added increase the weight about five-fold, then the material was washed for 10 min via an ultrasonic dispersion device, and the suspension was again centrifuged to remove the solids.

After washing, the solids were spread on filter paper for drying by evaporating the moisture at room temperature to obtain resin particles.

20 parts of these resin particles were placed in a beaker, and 100 parts IP Solvent 1620, and 20 parts basic barium Petronate (Witco Chemical Co.) were added as a washing solution, and the material was mixed for 48 hr at 200 rpm and room temperature using a stirrer.

The slurry mixture was centrifuged at 10,000 rpm for 5 min to remove the solids. The obtained solid was spread on a filter paper and dried at room temperature until the surface was slightly wet to obtain washed resin particles.

To 3 parts of the washed resin particles was added 100 parts IP Solvent 1620, and 0.5 parts of the same basic barium Petronate as during washing, and the material was mixed and subjected to a dispersion process for 5 min using an ultrasonic dispersion device to obtain liquid developer 4*b*. This developer contained toner particles having a volume-average particle size of 1.76 μm.

Liquid Developer 5b (Example 5b) (Wet-type Pulverization)

Liquid developer 5b was produced in the same manner as liquid developer 1b with the exception that petroleum calcium sulfonate Sulfol Ca-45N (Matsumura Sekiyu Kenkyujo) was substituted for the petroleum barium sulfonate Sulfol Ba-30N added as a charge controller. The obtained toner particles had a volume-average particle size of 1.51 μm.

Liquid Developer 6b (Example 1b) (Wet-type Pulverization)

Liquid developer 6b was produced in the same manner as liquid developer 1b with the exception that lithium (tablet lithium; Waco Pure Chemical Industries, Ltd.) was substituted for the petroleum barium sulfonate Sulfol Ba-30N as a charge controller. The obtained toner particles had a volume-average particle size of 1.58 μm.

Liquid Developer 7b (Comparative Example 2b) (Wet-type Pulverization)

Liquid developer 7b was produced in the same manner as liquid developer 2b with the exception that lauryl methacrylate/N-vinyl-2-pyrrolidone copolymer (composition ratio 95:5) was substituted for alkylbenzene barium sulfonate Sulfol Ba-30N as a charge controller. The volume-average particle size of the obtained toner particles was 1.52 μm.

Liquid Developer 8b (Comparative Example 3b) (Wet-type Pulverization)

Liquid developer 8b was produced in the same manner as liquid developer 1b with the exception that polyester resin 3b was substituted for polyester resin 1b, and the volume-average particle size of the obtained toner particles was 1.56 μm.

The laurylmethacrylate/N-vinyl-2-pyrrolidone copolymer (composition ratio 95:5) used in the manufacture of liquid developer 7b was produced in the following manner.

95 g laurylmethacrylate was dissolved in 200 g IP Solvent 1620 (Idemitsu Sekiyu Kagaku), and argon gas was pumped into the solution for 10 min to accomplish argon gas conversion of the entire reaction system. Then, 1 molar % benzoylperoxide (BPO) was added to the lauryl methacrylate monomer as a polymerization initiator and a polymerization reaction was induced for 4 hr at 80° C. After the reaction system was cooled to 30° C., 5 g N-vinyl-2-pyrrolidone monomer was added, and finally 1 molar % azobisisobutylonitrile (AIBN) was added relative to the N-vinyl-2-pyrrolidone monomer and allowed to stand for 4 hr at 90° C. to complete the polymerization. The obtained laurylmethacrylate/N-vinyl-2-pyrrolidone copolymer liquid was designated copolymer A.

Liquid Developer 9b (Comparative Example 4b (Wet-type Pulverization)

Liquid developer 9b was produced in the same manner as liquid developer 1b with the exception that polyester resin 4b was substituted for polyester resin 1b, and the volume-average particle size of the obtained toner particles was 1.46 μm.

Liquid developers 1b 9b were evaluated for changes in fixing characteristics, and image density and edge effect both before and after 10,000 image formations using the image forming apparatus shown in FIG. 1 and using stability over time as a parameter.

Fixing characteristics were evaluated by whether or not offset phenomenon occurred. Offset is a phenomenon wherein toner is not fused by the amount of heat applied during fixing such that said unfixed toner adheres to the fixing roller and causes visible defects in the produced image.

The evaluation of the change in image density and edge effect before and after 10,000 image formations has been previously described relative to Table 1 and are therefore omitted.

Results are shown in Table 2 below.

TABLE 2

| | Tg | Charge controller | Fixing characteristics | Stability: Image density Start | Image density After 10,000 | Edge ratio Start | Edge ratio After 10,000 |
|---|---|---|---|---|---|---|---|
| Ex 1b | 60.3 | Petroleum Ba sulfonate | A | 2.3 | 2.2 | 1.1 | 1.0 |
| Ex 2b | 35.1 | Petroleum Ba sulfonate | A | 2.1 | 2.1 | 1.1 | 1.1 |
| Ex 3b | 60.3 | Ba alkylbenzene sulfonate | A | 2.2 | 2.1 | 1.1 | 1.1 |
| Ex 4b | 60.3 | Basic Ba Petronate | A | 2.3 | 2.2 | 1.0 | 1.0 |
| Ex 5b | 60.3 | Basic Ba Petronate | A | 2.1 | 2.2 | 1.0 | 1.0 |
| CE 1b | 60.3 | Lecithin | A | 2.1 | 1.4 | 1.1 | 1.8 |
| CE 2b | 35.1 | N-vinyl-2-pyrrolidone/lauryl methacrylate | A | 2.0 | 1.8 | 1.1 | 1.9 |
| CE 3b | 74.9 | Petroleum Ba sulfonate | B | Unable to fix | Unable to fix | Unable to fix | Unable to fix |
| CE 4b | 33.1 | Petroleum Ba sulfonate | B | 2.0 | 1.5 | 1.1 | 1.8 |

When the glass transition temperature Tg was 65° C. or higher (Comparative Example 3b), fixing did not overtake the fixing speed and offset occurred, whereas high-speed fixing was realized at a lesser Tg.

On the other hand, when a polyester resin having a low Tg and oil-soluble ionic surface active agent were used (Examples 1b~5b), stable images were obtained even after long term use, whereas when other charge controllers were used (Comparative Examples 1b, 2b) there was marked deterioration in images after long term use.

Although the reasons for this difference are unclear, polyester resins with low Tg are primarily unstable substances and are readily swollen by the carrier fluid or fuse to other resin particles, suggesting that the reason for said difference may be that the oil-soluble ionic surface active agent coats the resin so as to obstruct the aforesaid swelling and fusion.

Excellent stability cannot be obtained when Tg is lower than a predetermined value, i.e., less than 35° C. (Comparative Example 4b). This suggests it is difficult to maintain the stability of the resin when the Tg is too low.

The liquid developers of the present invention of Examples 1~5 using polyester resin having a glass transition temperature of 35° C. and higher but less than 65° C. as a binder resin and using an oil-soluble ionic surface active agent as a charge controller provided excellent stability and excellent image density and edge effect both before and after 10,000 image formations.

On the other hand, liquid developer of Comparative Example 1b which used the ampholytic surface active agent lecithin as a charge controller, and Comparative Example 2b which used a nonionic laurylmethacrylate/N-vinyl-2-pyrrolidone copolymer as a charge controller had excellent image density and edge ratio at the initial image formation, but had unsatisfactory results after 10,000 image formations, and were ultimately unstable. The liquid developer of Comparative Example 3b which used a polyester resin having glass transition temperature of 74.9° C. as a binder resin was incapable of being fixed.

Therefore, providing for an glass transition temperature within the range of the present invention in a liquid developer for electrophotography using a polyester resin as a toner blander resin can provide a liquid developer for electrophotography having excellent stability over time and provide fast fixing speed.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A liquid developer for electrophotography comprising:

an electrically insulated fluid medium;

an oil-soluble ionic surface active agent;

colored particles; and a binder resin having an acid value of 40 mgKOH/g or higher but less than or equal to 100 mgKOH/g.

2. A liquid developer for electrophotography comprising:

an electrically insulated fluid medium;

an oil-soluble ionic surface active agent;

colored particles; and a binder resin having a glass transition temperature Tg of 35° C. or higher but less than or equal to 65° C.

3. The liquid developer of claim 1, wherein said oil-soluble ionic surface active agent is selected from one or more of the group consisting of alkylallyl sulfonate having an alkyl group with 20 or more carbon atoms.

4. The liquid developer of claim 3, wherein the oil-soluble surface active agent is selected from one or more of the group consisting of alkylbenzenesulfonate having an alkyl group of 20 or more carbon atoms and calcium salts and barium salts thereof; petroleum sulfonate and barium salts, calcium salts and magnesium salts thereof; and basic petroleum sulfonate and barium salts, calcium salts and magnesium salts thereof.

5. The liquid developer of claim 1, wherein the oil soluble surface active agent is present at about 0.01 to about 5 weight % relative to a weight of the fluid medium.

6. The liquid developer of claim 5, wherein the oil soluble surface active agent is present at about 0.01 to about 50 weight % relative to a weight of the fluid medium and at about 0.01% to about 50% relative to a weight of the toner.

7. The liquid developer of claim 1, wherein said binder resin comprises a polyester resin.

8. The liquid developer of claim 7, wherein said polyester resin is selected from the group consisting of isophthalic acid and terephthalic acid.

9. The liquid developer of claim 1, wherein said binder resin comprises a resin selected from the group consisting of styrene-acrylic copolymer resin, styrene-acrylic modified polyester resin, polyolefin copolymer, epoxy resin, rosin modified phenol resin and rosin modified maleic acid resin.

10. The liquid developer of claim 2, wherein said binder resin comprises a resin selected from the group consisting of styrene-acrylic copolymer resin, styrene-acrylic modified polyester resin, polyolefin copolymer, epoxy resin, rosin modified phenol resin and rosin modified maleic acid resin.

11. The liquid developer of claim 1, wherein the fluid medium has a resistance value of about $10^{11}$ to about $10^{16}$ ohm-cm.

12. The liquid developer of claim 1, wherein said fluid medium is selected from the group consisting of aliphatic hydrocarbons, alicyclic hydrocarbons, aromatic hydrocarbons, halogenated hydrocarbons, polysiloxane, normal paraffin solvents, and isoparaffin solvents.

13. A method for manufacturing a liquid developer comprising:

kneading a colorant and a binder resin that has a acid value of 40 mg KOH/g or higher but less than or equal to 100 mg KOH/g to disperse the colorant in the binder resin;

pulverizing the kneaded material;

grinding the pulverized material in a fluid medium that contains an oil-soluble surface active agent;

finely pulverizing the ground material; and optionally diluting the finely pulverized material.

14. A method for manufacturing a liquid developer comprising:

kneading a colorant and a binder resin that has a glass transition temperature Tg of 35° C. or higher but less than or equal to 65° C. to disperse the colorant in the binder resin;

pulverizing the kneaded material;

grinding the pulverized material in a fluid medium that contains an oil-soluble surface active agent;

finely pulverizing the ground material; and optionally diluting the finely pulverized material.

15. The method of claim 13, wherein the binder resin is a polyester resin.

16. The method Of claim 15, wherein the polyester resin is selected from one or more of the group consisting of isophthalic acid and terephthalic acid.

17. The method of claim 13, wherein the oil-soluble surface active agent is selected from one or more of the group consisting of alkylallyl sulfonate having an alkyl group with 20 or more carbon atoms.

18. The method of claim 17, wherein the oil-soluble surface active agent is selected from one or more of the group consisting of alkylbenzenesulfonate having an alkyl group of 20 or more carbon atoms and calcium salts and barium salts thereof; petroleum sulfonate and barium salts, calcium salts and magnesium salts thereof; and basic petroleum sulfonate and barium salts, calcium salts and magnesium salts thereof.

19. A device for forming an electrophotographic image using the liquid developer of claim 1 comprising:

a photosensitive drum;

a charger sequentially arranged around said photosensitive drum;

an image exposure member, wherein said image exposure member generates an electrostatic image on a surface of said photosensitive drum;

a liquid developing member, wherein said liquid developing member develops said electrostatic image on said surface of said photosensitive drum;

an image transferring member, wherein said image transferring member transfers said developed image to a sheet; and an image fixing member, wherein said image fixing member fixes said developed image on said sheet;

wherein said device develops said electrophotographic image at a speed of up to 100 cm/sec.

20. A method for forming an electrophotographic image using the liquid developer of claim 1 comprising:

rotating a photosensitive drum;

uniformly charging a surface of said photosensitive drum;

irradiating said surface of said photosensitive drum to form an electrostatic image thereon;

developing said electrostatic latent image on said surface of said photosensitive drum with said liquid developer;

transferring said developed image onto a sheet; and fixing said developed image onto said sheet.

21. The method of claim 20, wherein said electrophotographic image forming is carried out at a developing speed of up to about 1000 mm/sec.

22. The method of claim 13, wherein the polyester resin is produced by polymerizing polyvalent alcohol and polyvalent basic acid.

23. The method of claim 22, wherein said polyvalent alcohol is selected from one or more of the group consisting of ethylene glycol, diethylene glycol, triethylene glycol, propylene glycols such as 1,2-propylene glycol and the like, dipropylene glycol, butane diols such as 1,4-butane diol and the like, neopentyl glycol, alkylene glycols such as hexane diols, alkylene oxides thereof, bisphenol-A, bisphenols such as hydrogen-added bisphenol and the like, phenol glycols of alkylene oxides thereof, aliphatic and aromatic diols such as monocyclic or polycyclic diols, glycerin; and triols such as trimethylolpropane.

24. The method of claim 22, wherein said polyvalent alcohol is selected from one or more of the group consisting of 2~3 molar alkylene oxide adduct of neopentylglycol and bisphenol-A.

25. The method of claim 24, wherein said alkylene oxide adduct is selected from one or more of the group consisting of ethylene oxide and propylene oxide.

26. The method of claim 22, wherein the polyvalent basic acid is selected from one or more of the group consisting of malonic acid, succinic acid, adipic acid, azelaic acid, sebacic acid, fumaric acid, maleic acid, itaconic acid, phthalic acid, and modified acids thereof; saturated and unsaturated bivalent basic acids such as isophthalic acid, terephthalic acid and the like, saturated polyvalent basic acids having three functional groups such as trimellitic acid, tritrimesic acid, pyromellitic acid; and acid anhydrides and low molecular weight alkyl esters thereof.

* * * * *